US005469932A

United States Patent [19]

McNair

[11] Patent Number: 5,469,932

[45] Date of Patent: Nov. 28, 1995

[54] SOUND BARRIER WITH OBLIQUE SURFACES

[76] Inventor: Edward P. McNair, 59 Chimney Ridge Dr., Morristown, N.J. 07960

[21] Appl. No.: 257,367

[22] Filed: Jun. 9, 1994

[51] Int. Cl.[6] ..... E04H 17/00

[52] U.S. Cl. ..... 181/210

[58] Field of Search ..... 181/210, 285, 181/286, 287, 293, 295; 52/144, 145

[56] References Cited

U.S. PATENT DOCUMENTS

| | | | |
|---|---|---|---|
| 3,812,931 | 5/1974 | Hauskins, Jr. | 181/210 |
| 4,095,669 | 6/1978 | Bond, Sr. | 181/210 |
| 4,114,725 | 9/1978 | Croasdale | 181/210 X |
| 4,306,631 | 12/1981 | Reusser | 181/210 |
| 5,217,771 | 2/1993 | Schmanski | 428/369 |
| 5,272,284 | 8/1993 | Schmanski | 181/210 |

OTHER PUBLICATIONS

Albers, Vernon—"The World of Sound", 1970 As Barns & Co. Inc. Ch 4 Sound Propagation in Part —pp. 60–65.

Doelle, Leslie—"Environmental Acoustics", 1972 McGraw Hill Inc. p. 18, Fig. 3.7; p. 139, Fig. 13.2.

Rettinger, Michael—"Acoustics", 1968 Chemical Publishing Co, Inc. p. 125 Table Band–pressure . . . p. 207, Fig. 61.

Kinsler, Frey, Coppens, Sanders—"Fundamentals of Acoustics—Third Ed", 1982 John Wiley & Sons Inc. p. 322, Fig. 13.2.

Rossing, Thomas—"The Science of Sound Second Ed.", 1989 Addison—Wesley Pub. Co., Inc. Par 3.9 pp. 46–47, Par. 3.10 pp. 47–48.

Lipscomb, Taylor—"Noise Control—Handbook of Principles and Practices", 1978 Van Nostrand Inc. p. 268 Fig. 10–6, p. 269 Fig. 10–7.

*Primary Examiner*—Khanh Dang

[57] ABSTRACT

A sound barrier partition (22) having multiple faces (30) covering a vertical wall (24) of the partition (22) that fronts a highway. The faces (30) on each partition (22) are of sufficient size and shape to effectively reflect most of the frequencies of sound generated by highway traffic and heard by the human ear. Sound barriers are usually installed on both sides of a highway. The faces (30) are positioned obliquely so that a ray (R) of sound will strike face (30) at a high angle of incidence and be reflected at a higher angle above the horizontal. When sound rays travel a substantial distance above the top edge of the corresponding barrier on the opposite side of the highway, the amount of audible sound that is diffracted and refracted towards inhabited areas adjacent to the highway is reduced.

14 Claims, 10 Drawing Sheets

FIG. 3
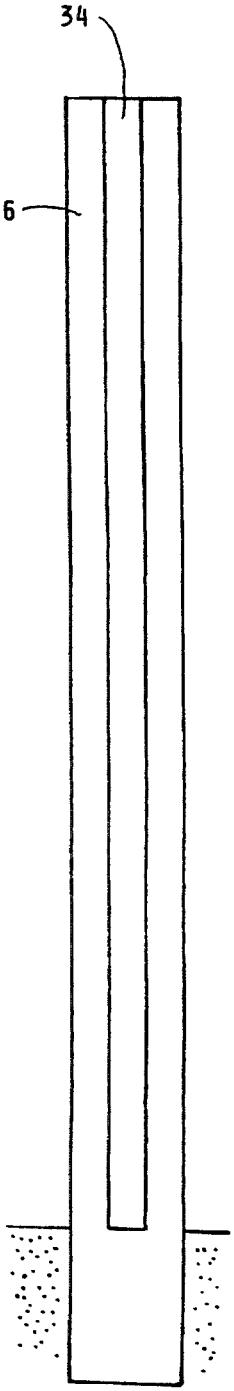
FIG. 11
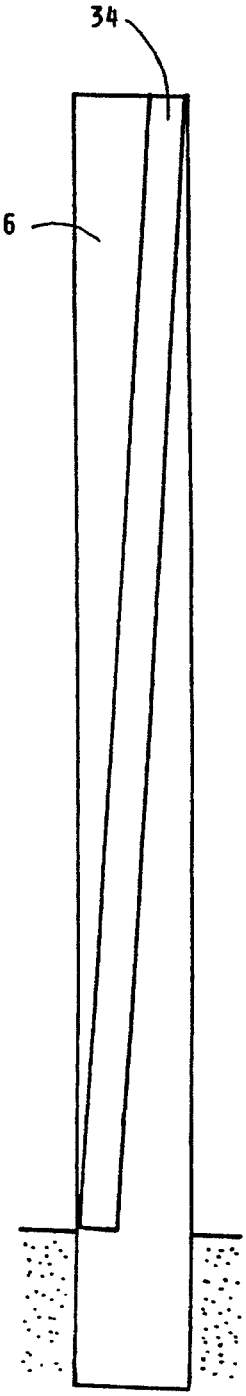
FIG. 7A
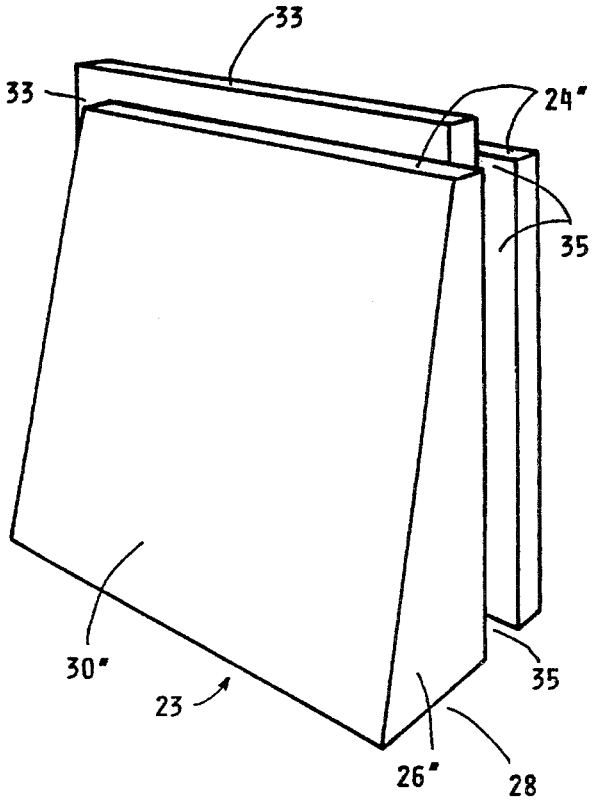
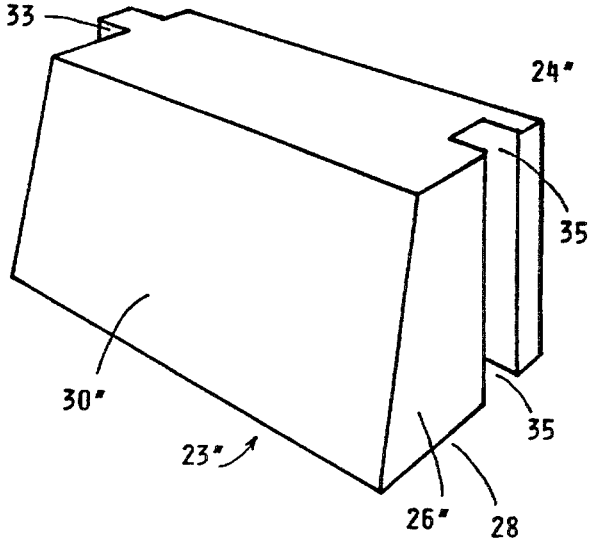
FIG. 7C

SOUND BARRIER WITH OBLIQUE SURFACES

BACKGROUND OF THE INVENTION

1. Field of the Invention

The present invention pertains to highway sound barriers whose inside walls have multiple faces tilted to aim reflected sound energy away from populated areas.

2. Description of Prior Art

Since the passage of the Federal Noise Control Act of 1972, increased effort has been placed on minimizing the amount of highway noise, or unwanted sound, that is transmitted to nearby residential areas. The choice of type of sound barrier is usually based on relative costs. Because of concrete's versatility and low material cost, many states choose vertical sound barriers that are constructed of prefabricated concrete panels or sub-panels which fit tongue and groove into vertical posts, forming vertical walls. Other states prefer to use vertical walls made of wood or concrete block. Since the prefabricated parts are easy to transport and are durable in an outdoor environment, construction and maintenance costs are low. Vertical barriers occupy very little horizontal space across a highway right of way and are easy to install in a wide variety of situations, including sloping terrain and curving roadways.

A three inch thick concrete highway sound barrier has a ASTM sound transmission class (STC) rating of 47 dB noise reduction; however, a pair of barriers 3 to 11 meters (10 to 35 feet) high, placed on opposite sides of a highway, achieve only 7 dB to 15 dB of noise reduction.

Most highway noise heard by people at ground level beyond sound barriers has passed over these barriers rather than through them. As sound energy passes over the sound barrier rays of sound close to the top edge of the barrier will be diffracted downward. Whether they are bent downward enough to be heard at ground level depends on how close the rays are to the top edge, and how nearly horizontal the rays are traveling as they pass over the barrier.

In addition, when downward atmospheric refraction occurs, sound traveling at a low angle to the horizontal will be refracted to the ground. This downward refraction is caused by temperature inversions and wind. In good weather, both are likely to occur during the evening hours as it cools. Unfortunately, in warm weather, that is the time of day that people want to use their back yards the most.

Above 35 miles per hour, the dominant noise generated by highway traffic is tire noise. On a highway, tire noise will occur on all parts of both roadways. Therefore, sound rays, reflected from a corresponding barrier on the opposite side of the highway passing close to the top of a barrier will be travelling in a direction that is more nearly horizontal than rays direct from the road surface.

Concrete and wood sound barriers have very poor sound absorptivity. The Sabine absorptivity for poured, unpainted concrete is less than 0.05 on a scale of 0 to 1 for all frequencies of sound below 4,000 Hz. Wood barriers have an absorptivity index less than 0.1. When sound strikes one of these sound barriers the incident sound energy not absorbed by the barrier is reflected. Because of the low Sabine number of concrete and wood, 90% to 95% of the sound energy that strikes a sound barrier having vertical walls made of these materials will be reflected.

Even though there is a 5% to 10% loss of energy when the sound is reflected, this is compensated for by the lower angle of the reflected sound rays. Because of diffraction, at 150 feet or more beyond the barrier, the reflected sound level will equal or exceed the direct sound level. When two sound sources of equal intensity merge, the total sound level is increased by 3 dB. Refraction can further intensify the sound, amplifying the reflected sound more than the direct sound.

Thus sound barriers with sound reflective vertical walls facing the highway from both sides of the right of way create reflected sound that is counterproductive to the barriers' purpose of reducing the highway noise level in order to preserve the value and enjoyment of a residential area.

Concrete barriers have been installed with their flat panels tilted away from the highway. This will cause sound to be reflected upward but the installation of these panels is more difficult and expensive. The columns must also be installed at an angle. This requires special post hole diggers that can dig deep holes at a slant and two lifting devices to guide the columns into their holes rather than a single crane to lower the columns into vertical holes. If the the columns are cantilevered they have to be longer since deeper footings are required. Temporary outrigger supports are needed while the concrete footings strengthen. The panels are difficult to insert in the grooves of the columns and custom panels are required for curves in the roadway. The tilted walls and any permanent outrigger supports are unattractive from the outer side so this type of barrier is unsuitable for installation when abutting back yards and other populated land areas.

SUMMARY OF THE INVENTION

Objects and Advantages

The object of the present invention is to provide highway sound barriers that have multiple faces designed to direct the reflected noise away from ground level in populated areas. The advantages of such barriers are:

(a) rays of reflected sound traveling at a higher angle to the horizontal will require more diffraction and refraction so less of the reflected noise will reach the vicinity of ground level;

(b) rays of reflected sound will be aimed higher than the second floor of nearby residences;

(c) in some cases, the need for a second barrier on the other side of the highway is eliminated;

(d) when barriers line both sides of the highway, there will be less buildup of reverberating noise on the highway;

(e) barriers can be fabricated and installed in the same manner as conventional barriers;

(f) the increase of barrier width, as measured across the highway right of way, is negligible, therefore a wider right of way is not required;

(g) the outside of the barrier will have the same appearance as current vertical barriers;

(h) the face of the barrier on the highway side presents an attractive appearance;

Still further objects and advantages will become apparent from a consideration of the ensuing description and drawings.

BRIEF DESCRIPTION OF THE DRAWINGS

FIG. 3 is a elevation (side) view of the column shown in FIG. 1.

FIG. 7A is a perspective view of a concrete or masonry block suitable for use as a component of either the partition shown in FIG. 1 or FIG. 5.

FIG. 7C is a truncated block similar to the bottom half of the block shown in FIG. 7A.

FIG. 11 is a elevation (side) view of the column shown in FIG. 10.

FIG. 12 is a perspective view similar to FIG. 1; however, the inclined faces are formed by fastening planks to the vertical wall.

DESCRIPTION OF THE INVENTION

Figure 1:
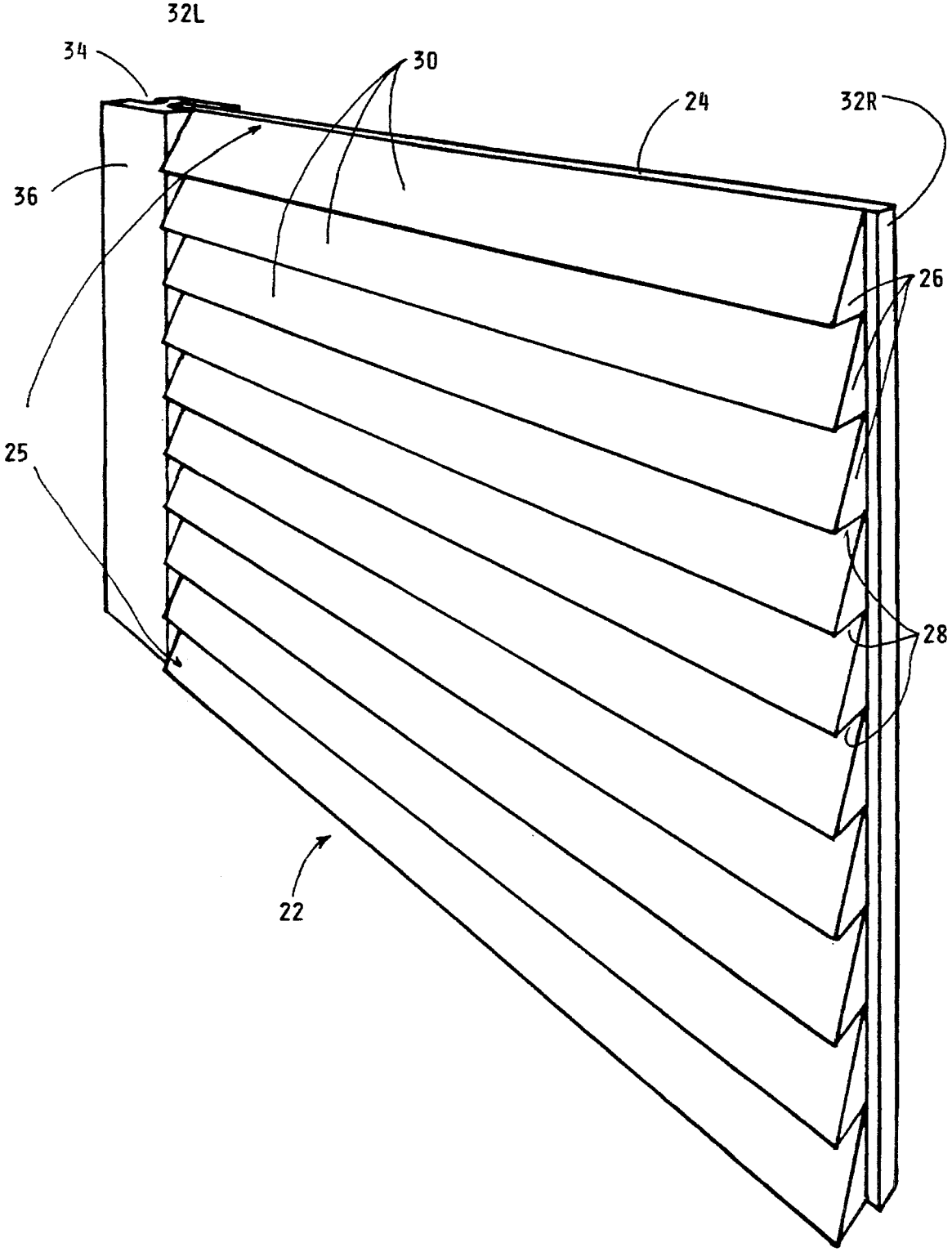
FIG. 1 is a perspective view of a concrete sound barrier partition. On the side of the partition that faces the noise source, inclined faces extend horizontally the width of the partition.

The preferred embodiment of the invention, illustrated in FIGS. 1, 2, 3, 4A and 4B, is a vertical sound barrier partition 22 approximately 6.10 meters (twenty feet) high made of a monolithic assembly of cast concrete. Typically, as with conventional concrete sound barriers, partition 22 has a vertical, imperforate wall 24 from ten to twenty feet long and a vertical column 36 at each end of wall 24. A contiguous tier 25 of horizontally disposed, congruent, right triangular prisms, or wedges 26, cover wall 24 that front a road surface 38. Each wedge 26 extends the width of wall 24 between vertical columns 36. Wedge 26 has a base 28. A sound reflective face 30 of wedge 26 is inclined to wall 24 by an angle A'. Tier 25 of wedges 26 extends from ground level to the top of wall 24.

Face 30 of each wedge 26 has a rectangular shape. At both ends of partition 22, from top to bottom, thin strips of wall 24 extend beyond wedges 26 to form tongues 32L (left) and 32R (right). On the left end of partition 22, tongue 32L fits into a groove 34 on column 36. On the right end of partition 22, tongue 32R fits into groove 34 of column 36 (not shown).

Figure 2:
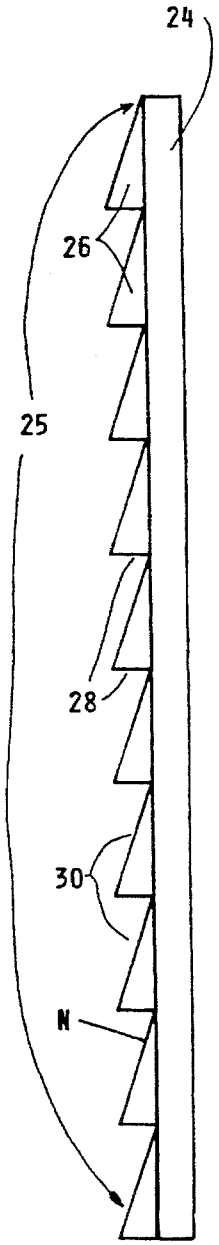
FIG. 2 is a elevation (side) view of the sound barrier partition shown in FIG. 1.

In in FIG. 2, the elevation (side) view shows that wedge 26 has the shape of a right triangular prism with face 30 forming the hypotenuse. The slant height of face 30 is designed to be no less than 0.61 meters (two feet).

FIG. 3 shows column 36 with groove 34 extending vertically from ground level to the top of column 36. Tongues 32L and 32R fit into grooves 34 of columns 36. Columns 36 are approximately the same height above ground as partition 22. Columns 36 are rigidly embedded in the ground.

Figure 4A:
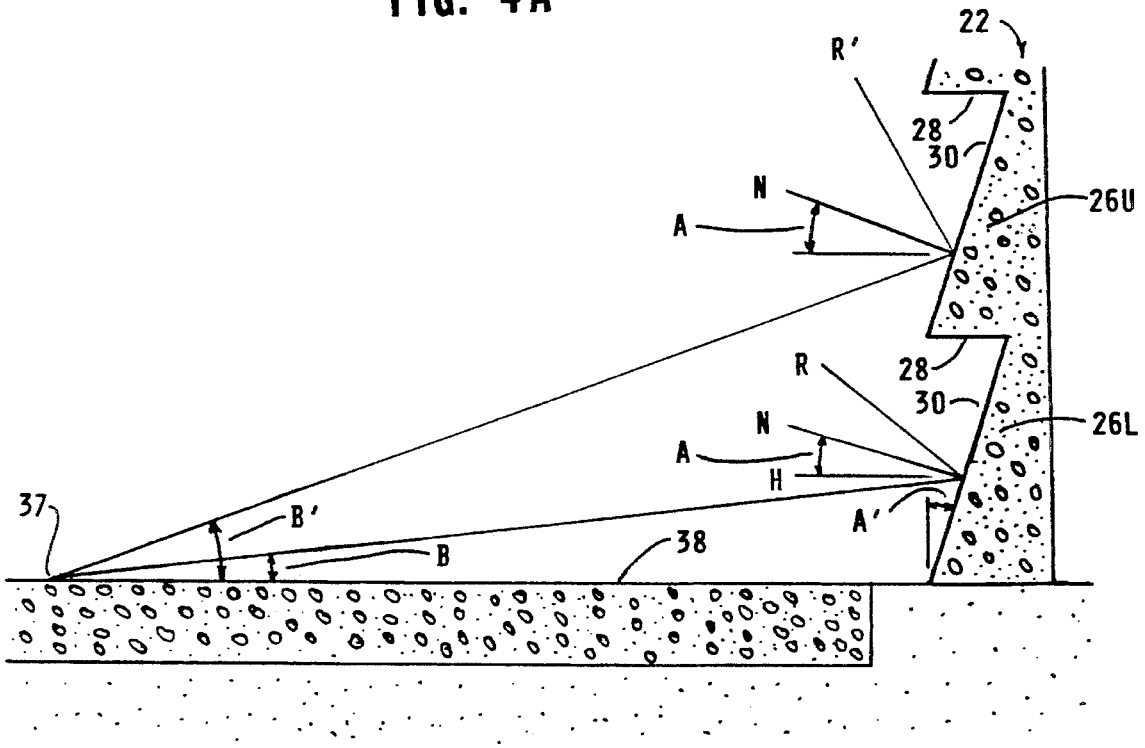
FIGS. 4A and 4B are cross sections of a portion of the partition in FIG. 1 and a portion of a road surface.
Figure 4B:
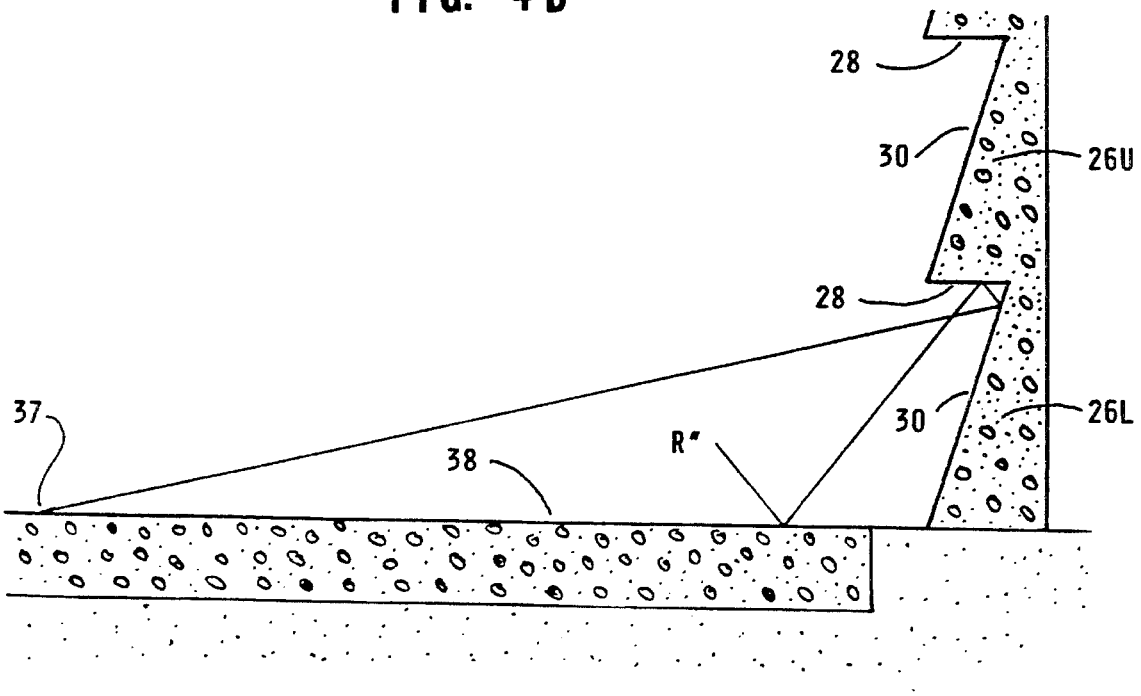

FIGS. 4A and 4B illustrate the reflection of sound rays by faces 30. A normal N is perpendicular to each face 30. Face 30 is positioned so that a normal N extending from face 30 outward is above a horizontal H by an angle A. Base 28 is opposite angle A'. Angle A' is less than 30 degrees; therefore, base 28 is less than half the size of face 30. Angle A between normal N and the horizontal is equal to angle A' between face 30 and the vertical.

Additional embodiments are shown in FIGS. 5 thru FIG. 14.

OPERATION OF THE INVENTION

The law of reflection for sound is that the angle of incidence between the incoming ray and the normal to the reflecting face is equal to the angle of reflection of the outgoing ray and the normal to the reflecting face. The normal is perpendicular to the reflecting face at the point of impact and would be horizontal for a vertical wall.

The law of sound reflection is valid if the wavelengths of the sound waves are small compared to the dimension of the reflective face 30. It has been verified experimentally that if the circumference of the reflector is equal to or greater than the wavelength of the sound, the ratio of the actual area to effective area is essentially unity. When that criterion is met, multiple small faces 30 can reflect sound as effectively as a single large reflector of the same total area as faces 30.

If the wavelength of the sound is larger than the circumference of the reflector, the effective area is approximately equal to the cube of the fraction resulting from dividing the circumference by the wavelength. If a face 30 has a circumference one tenth of the wavelength, the effective area will be only 0.001 of the actual area. A face 30 with a circumference that is half the wavelength would have only one eighth of the effective area. Thus, determining the circumference of face 30 will determine the largest wavelength that will be reflected by face 30 as effectively as any surface larger than face 30.

If a non circular face 30 is used, in order to duplicate the performance of a circular reflector, it can be assumed that face 30 should be designed to enclose a circle with the desired diameter; therefore, the smaller dimension of rectangular face 30 should at least equal the diameter of the desired circle. For the embodiments herein, wedges 26 are designed so that the minimum dimension of face 30 is the slant height.

Increasing the number of wedges 26 and thereby decreasing the size of each wedge 26 will reduce the mass of partition 22; however, it will also decrease the slant height of face 30. The slant height of face 30 in all embodiments shown has been predetermined to be 0.6096 meters (two feet) or more; therefore, it is predetermined that rays of sound with wavelengths of 1.92 meters (6.28 feet) or less that impinge on faces 30 will be reflected as effectively as they would be if they struck a single reflector covering wall 24. A wavelength of 1.92 meters (6.28 feet) or less corresponds to a frequency at or above 181 Hz. under standard conditions at sea level.

Tire noise is a composite function of tread pattern and road surface. Most tires in use today approach the minimum noise performance of a blank pattern radial tire. On a smooth highway, at 60 miles per hour, a blank radial will generate a peak intensity of approximately 65 dB of noise between 200 Hz. and 500 Hz. at 25 feet from the source. The intensity tapers off gradually at higher and lower frequencies, remaining at or above 55 dB from a frequency of 50 Hz. thru 2000

Hz.

The ability of the human ear to perceive sound diminishes below 1000 Hz. Because of this phenomena, commonly referred to as "loudness contour", a sound at 125 Hz. with an intensity of 57 dB and one at 250 Hz. with an intensity of 50 dB seem no louder than a sound at 1000 Hz. with an intensity of 40 dB. A sound with 10 dB lower volume is defined as sounding half as loud.

FIGS. 4A and 4B show the paths that some rays of sound caused by tire noise will take when originating on surface 38 and reflected from partition 22 in the preferred embodiment. A tire noise source 37 can occur on any part of surface 38 and strike all heights of partition 22. Two wedges 26L (lower) and 26U (upper) are mounted on partition 22. In FIG. 4A, sound rays R and R' are among those emitted from source 37. Angle B and angle B' represent the angle of departure of rays R and R' from source 37 on surface 38.

In FIG. 4A, rays R and R' impinge upon face 30 of wedges 26L and 26U. The angle of incidence to normal N for wedge 26L equals the sum of angles A and B. The angle of incidence to normal N for wedge 26U equals the sum of angles A and B'. Since the angle of incidence equals the angle of reflection, the total angle above the horizontal of the reflected rays R and R' will be 2(A)+B and 2(A)+B', respectively.

Some sound in the mid and upper frequencies will be reflected from bases 28 of wedges 26. In FIG. 4B, ray R" represents a ray of sound originating from source 37. Ray R" strikes face 30 of wedge 26L, is reflected, and then strikes base 28 of wedge 26U. Ray R" is reflected downward, striking surface 38, and then reflected upward, over the opposite barrier (not shown), along with sound originating from surface 38 that travels directly over the barrier.

The area of base 28 is half or less than the area of face 30 so the intensity of the sound reflected from base 28 will be half that of the sound reflected from face 30 or less. The sound will also lose 5% of its intensity every time it is reflected. By the time the sound reflected from base 28 has re-reflected from surface 38, its intensity will be at least 15 dB less than the direct sound and it will contribute less than 0.1 dB to the total sound level.

In contrast, barriers with vertical faces along both sides of a road can increase the noise level in the area between the barriers from 3 dB to 10 dB because of reverberation that is caused by sound being repeatedly reflected between the two barriers.

OTHER EMBODIMENTS

Figure 6:
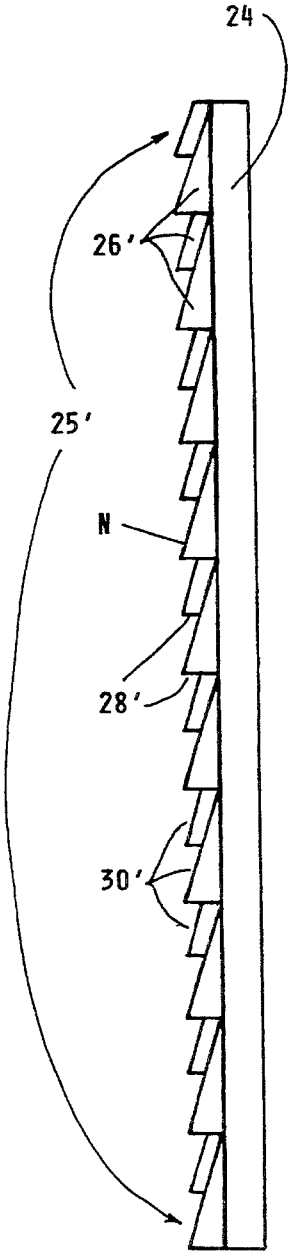
FIG. 6 is a elevation (side) view of a portion of the partition in FIG. 5.
Figure 5:
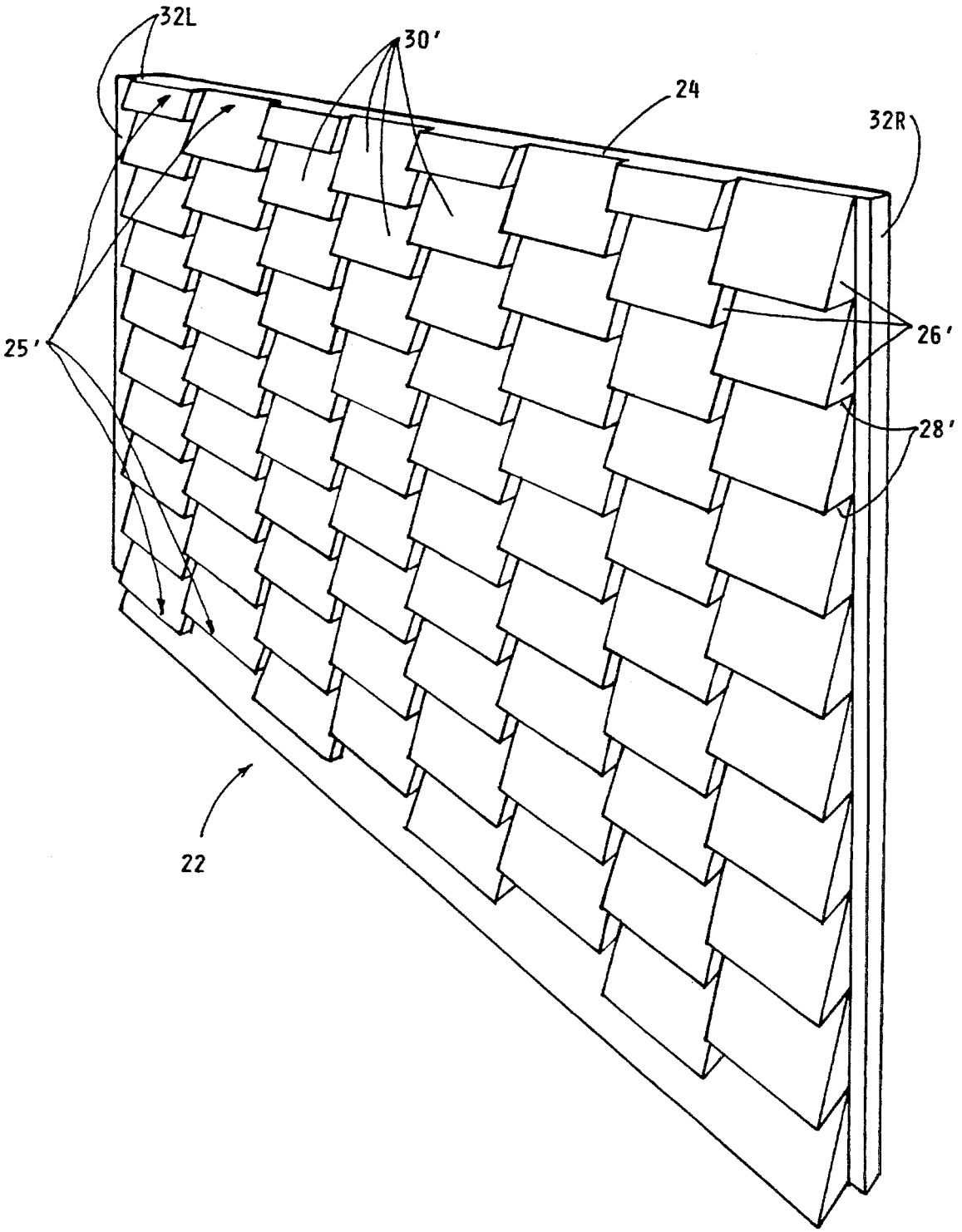
FIG. 5 is a perspective view of a partition similar to FIG. 1 with the inclined faces subdivided and having alternate vertical offsets.

A second embodiment of the invention is illustrated in FIGS. 5 and 6. Wedges 26' are arranged in multiple tiers 25' that cover wall 24 facing surface 38. Each adjacent tier 25' of wedges 26' is offset vertically by an amount equal to one half the height of wedge 26'. Each wedge 26' has a face 30". Wedges 26' are sufficiently wide that the width of face 30' is at least equal to the slant height of face 30'. Alternately offsetting wedges 26' contributes to the stiffness of partition 22.

Figure 7B:
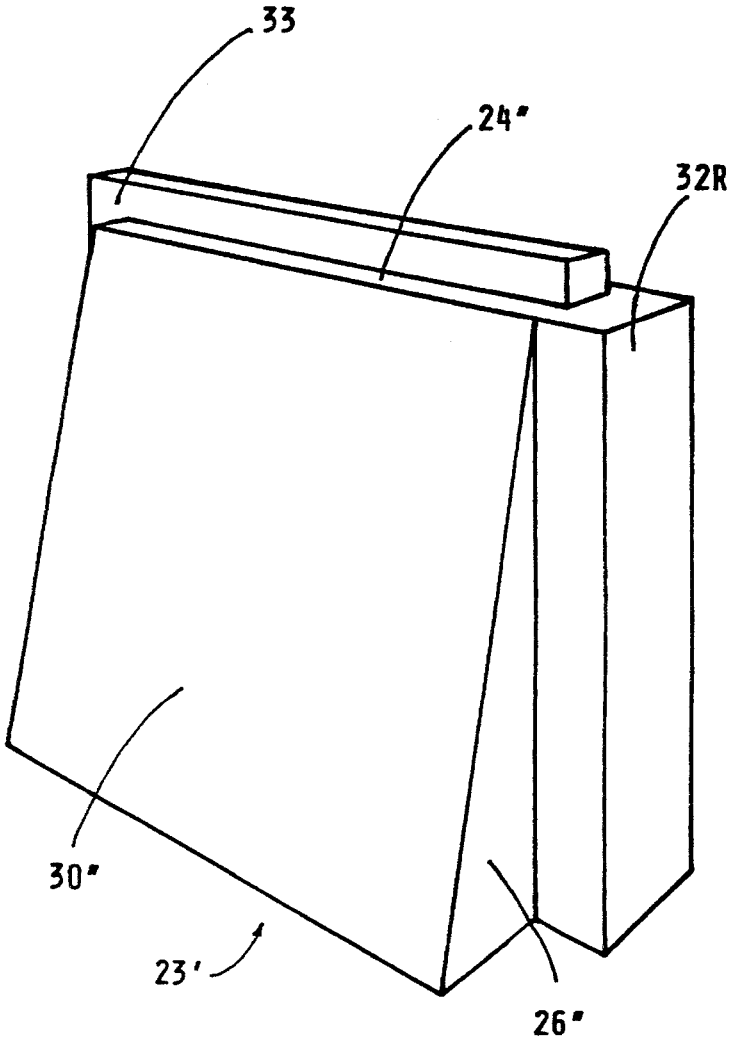
FIG. 7B is a perspective view of a block similar to the block shown in FIG. 7A; however, this block is used at the end of the panel and has a tongue to fit the groove of the column.
Figure 9:
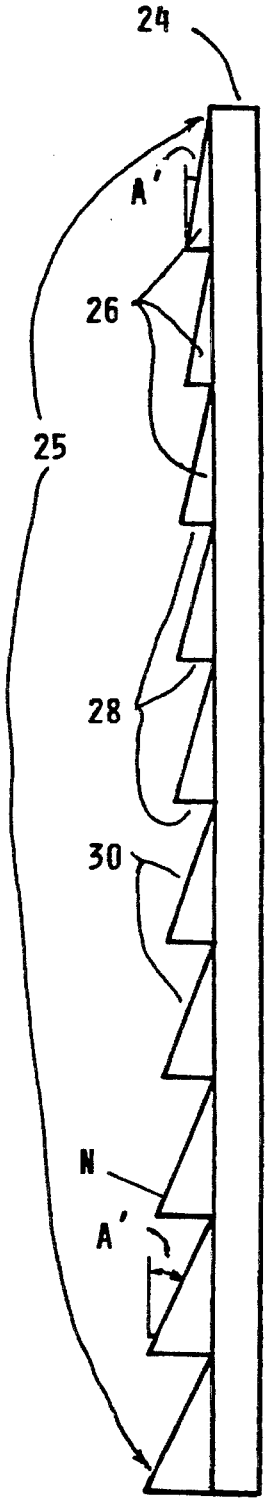
FIG. 9 is a elevation (side) view of a partition in which the slopes of the inclined faces are different at different heights above the base of the barrier.

In the third embodiment, FIG. 7A shows a concrete or masonry block 23 forming a wedge 26" and a wall section 24". Each wedge 26' has a face 30". Each block 23 has a small tongue 33 along the top edge and down one side of wall section 24". Block 23 has a small groove 35 along the bottom edge and down the opposite side of wall section 24". FIG. 7B shows a block 23' with tongue 32R for use at the end of the panel. FIG. 7C shows a block 23". Block 23" is a truncated bottom half of block 23 that can be placed on the top of partition 22 if it is desired to make alternate tiers 25' level.

Figure 8A:
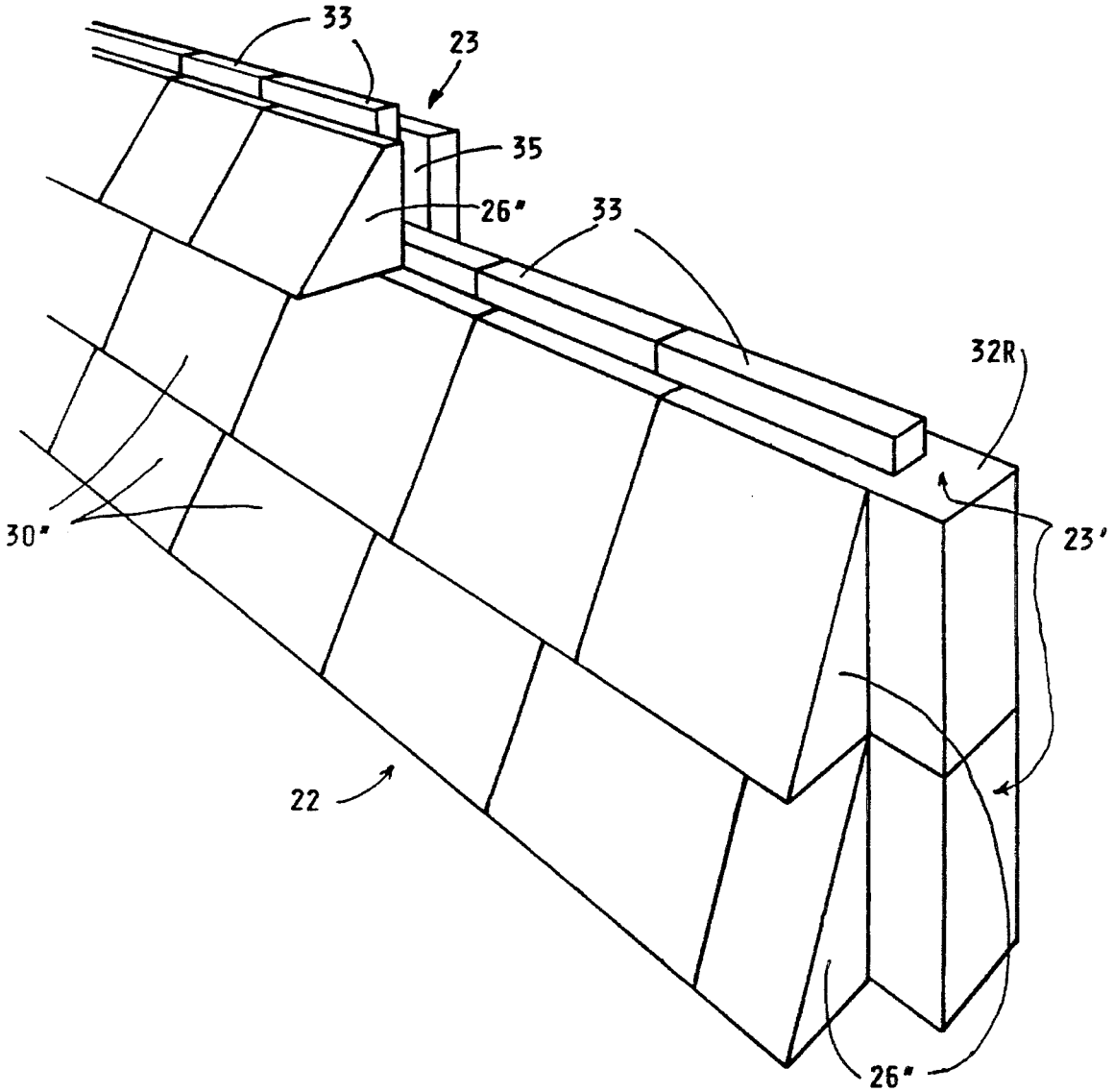
FIG. 8A is a partial perspective view of the blocks of FIG. 7A and 7B, partially assembled, with a horizontal offset.

FIG. 8A shows partially assembled partition 22 three blocks 23 high to illustrate multiple identical blocks 23 interlocked in a contiguous manner with a horizontal offset. Block 23' is at the end of partition 22. Block 23' has tongue 32R that fits into groove 34. Every other block 23' is half as wide as block 23 in order to achieve the horizontal offset of the rows of blocks 23.

Figure 8B:
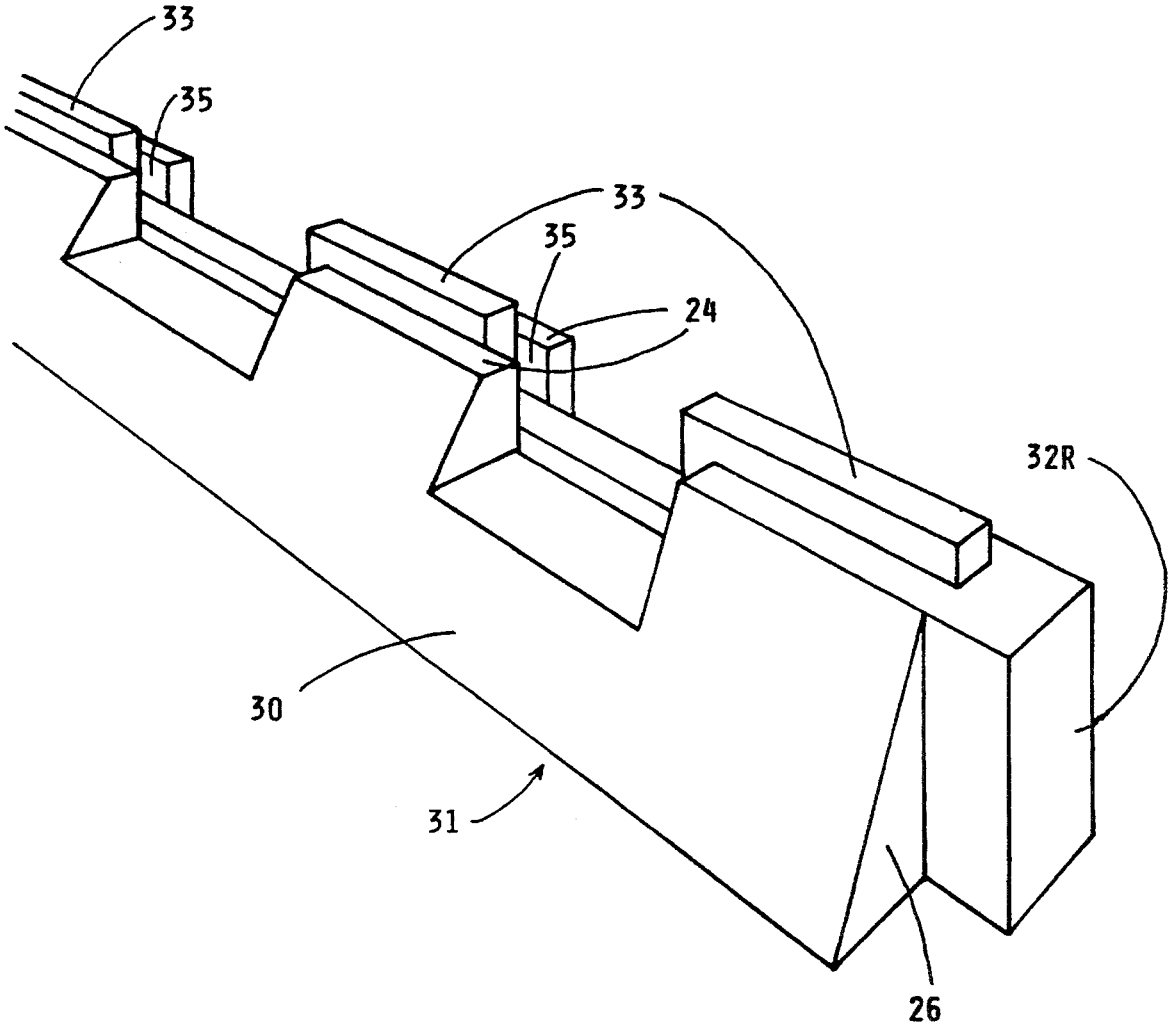
FIG. 8B is a partial perspective view of a footing used in in conjunction with the blocks of FIGS. 7A thru 7C to form the partition shown in FIG. 5.

FIG. 8B shows a footing 31 that can be used at the bottom of a partition comprised of blocks 23 to construct a partition similar to the one shown in FIG. 5.

Figure 8C:
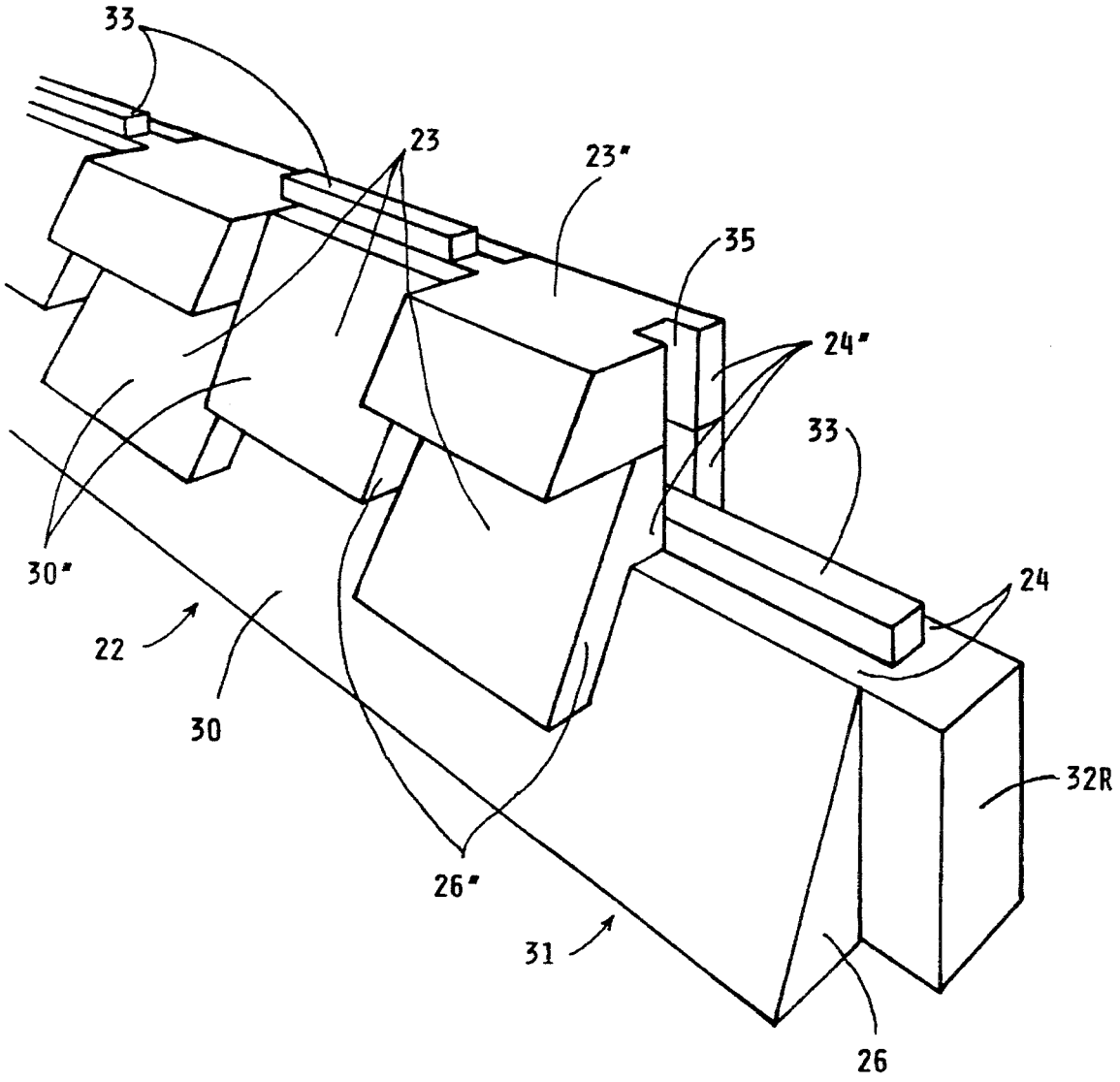
FIG. 8C is a partial perspective view of the blocks of FIG. 7A, 7C, and the footing of FIG. 8B; partially assembled, with a vertical offset.
Figure 10:
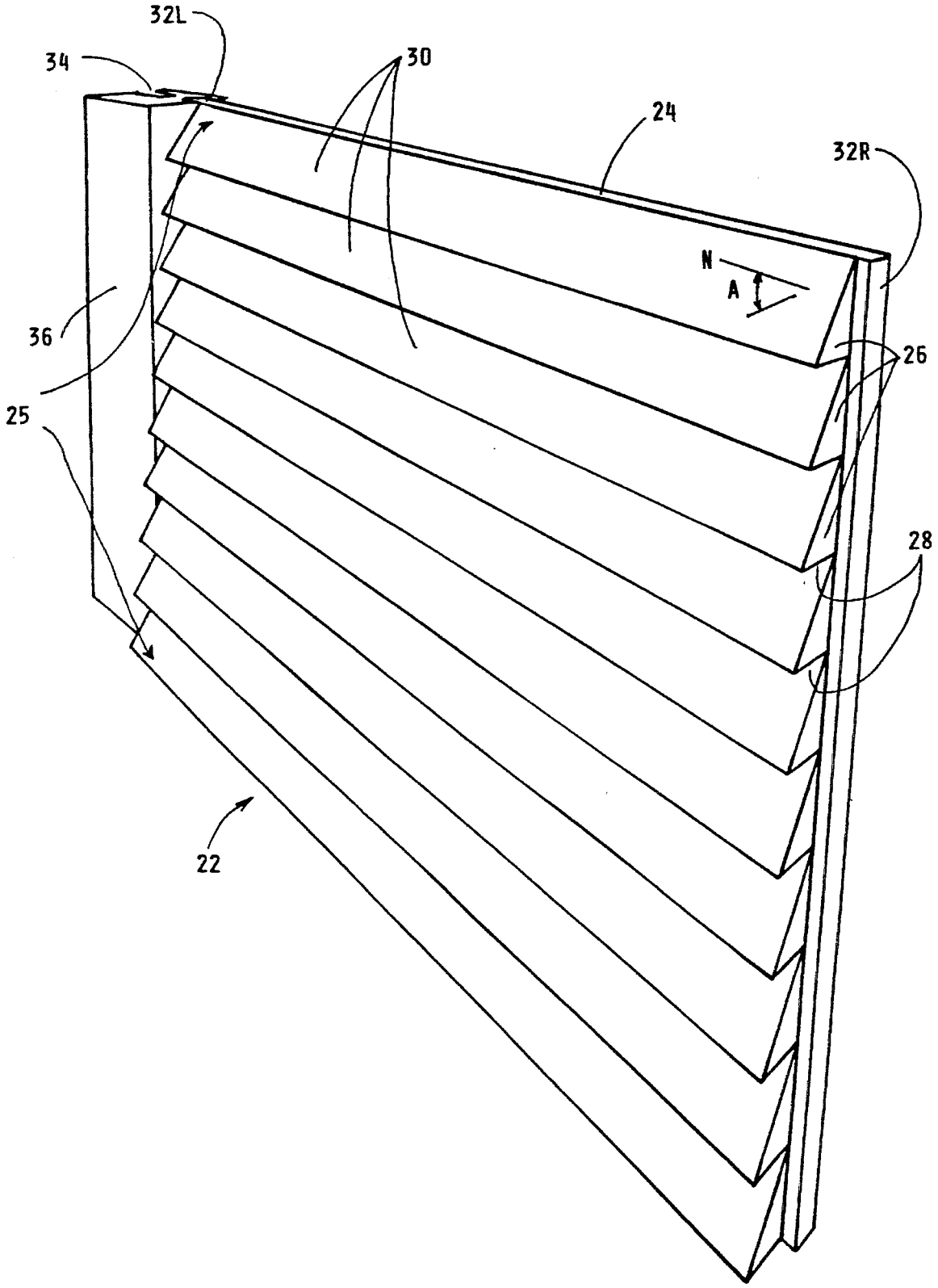
FIG. 10 is a perspective view of a partition similar to the partition shown in FIG. 1; however, in FIG. 12 the groove of the column is tilted away from the vertical so that the entire partition is tilted slightly back.

FIG. 8C shows partially constructed partition 22 shown in FIG. 5 with three blocks 23 high to illustrate the assembly of multiple identical blocks 23 interlocked in a contiguous manner with a vertical offset. To achieve the vertical offset, footing 31 is placed on level ground. Blocks 23 are placed on footing 31. To level the top of wall 24, blocks 23" can be placed on the tops of adjacent tiers 25 of blocks 23.

In the fourth embodiment shown in FIG. 11, angle A' for face 30 is large for lower wedges 26. Angle A' then gradually decreases with each higher wedge 26. This would reduce the amount of material required for partition 22.

In the fifth embodiment shown in FIGS. 12 and 13 partition 22 has been tilted back by tilting grooves 34 of column 36. This would increase angle A without increasing the size of wedges 26.

In the sixth embodiment, FIG. 14 shows wall 24 to which planks 40 have been attached. Planks 40 can be made of any material suitable for long term outdoor use, such as wood, concrete, or plastic. The top of plank 40 is attached directly to partition 22 and held in place with anchors 42. Side 30 of plank 40 is tilted upward with a spacer 43.

SUMMARY, RAMIFICATIONS, AND SCOPE

Half or more of the noise heard beyond dual highway noise barriers is reflected noise. By changing the direction that reflected sound travels, the impact of this noise will be greatly reduced.

Accordingly, the reader will see that the invention combines the performance of noise barrier having a large single surface that has been tilted away from the road, with the compactness, conservation of materials, and ease of construction of a vertical sound barrier wall.

Although the description above contains many specificities, these should not be construed as limiting the scope of the invention but as merely providing illustrations of some presently preferred embodiments of the invention. For example, the wedges are depicted as having a right triangular cross section with a base that is horizontal and a rectangular face. One skilled in the art might choose to replace the right angle of the triangle with an acute angle to increase the compressive strength of the structure, or replace the right angle with an obtuse angle to save material. The inclined faces can be positioned by other methods and they can have curved surfaces.

Thus the scope of the invention should be determined by the appended claims and their legal equivalents, rather than by the examples given.

I claim:

1. A sound barrier installed alongside a highway, said highway having a road surface, said barrier comprised of at least one partition and a means for supporting said partition, said partition being comprised of:

(a) at least one generally vertical imperforate wall;

(b) a plurality of wedge shaped protrusions, said wedge shaped protrusions, at least in part, covering a side of said wall, said side fronting said road surface;

(c) each said wedge shaped protrusion having at least one face inclined to a vertical;

(d) a plurality of said faces positioned so that a normal from each said face forms an angle above a horizontal, said faces being in the path of sound rays originating from said surface.

2. The faces of claim 1, wherein said faces cover at least a majority of said side.

3. The faces of claim 1, wherein said faces are generally planar.

4. The faces of claim 3, wherein said faces are inclined planes.

5. The partition of claim 1 wherein said partition is comprised of a monolithic assembly.

6. The partition of claim 1, wherein said partition is comprised of a plurality of blocks, said blocks being assembled in a contiguous manner.

7. The partition of claim 1, wherein said partition is comprised of at least one contiguous tier of a a plurality of said wedge shaped protrusions.

8. The faces of claim 1, wherein the minimum dimension of said faces is the slant height of said faces.

9. The slant height of claim 8, said slant height having a dimension of at least 0.61 meters (two feet).

10. The wedge shaped protrusions of claim 1, wherein each said wedge shaped protrusionn is comprised of at least one plank, and a means of attaching said plank to said wall.

11. A sound barrier installed alongside a highway, said highway having a road surface, said barrier being comprised of a partition and a means for supporting said partition, said partition being comprised of:

(a) a plurality of blocks, each said block being comprised of a generally vertical imperforate wall section having tongues on two sides and grooves on sides opposite said tongues, said blocks being assembled in a contiguous manner by said tongues and grooves, said wall sections comprising a generally vertical, imperforate wall;

(b) at least some of said blocks being comprised of at least one wedge shaped protrusion, each said wedge shaped protrusion being located on a side of said wall that fronts said road surface;

(c) each said wedge shaped protrusion having at least one face inclined to a vertical;

(d) a plurality of said faces being in the path of sound rays originating from said surface.

12. The faces of claim 11, wherein said faces cover at least a majority of said side.

13. The faces of claim 11, wherein said faces are generally planar.

14. The faces of claim 13, wherein said faces are inclined planes.

* * * * *